US011002105B2

(12) United States Patent
Tonti

(10) Patent No.: US 11,002,105 B2
(45) Date of Patent: May 11, 2021

(54) DOWNHOLE TOOL WITH RECESSED BUTTONS

(71) Applicant: INNOVEX DOWNHOLE SOLUTIONS, INC., Houston, TX (US)

(72) Inventor: Nick Tonti, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/662,792

(22) Filed: Oct. 24, 2019

(65) Prior Publication Data

US 2020/0131882 A1 Apr. 30, 2020

Related U.S. Application Data

(60) Provisional application No. 62/751,241, filed on Oct. 26, 2018.

(51) Int. Cl.
*E21B 33/129* (2006.01)
*E21B 23/01* (2006.01)

(52) U.S. Cl.
CPC ..... *E21B 33/129* (2013.01); *E21B 23/01* (2013.01); *E21B 33/1293* (2013.01)

(58) Field of Classification Search
CPC ..... E21B 33/129; E21B 33/1293; E21B 23/01
See application file for complete search history.

(56) References Cited

U.S. PATENT DOCUMENTS

| | | | | |
|---|---|---|---|---|
| 9,470,060 | B2 * | 10/2016 | Young | E21B 23/06 |
| 9,835,003 | B2 * | 12/2017 | Harris | E21B 43/26 |
| 9,927,058 | B2 * | 3/2018 | Sue | F16L 55/11 |
| 9,976,381 | B2 * | 5/2018 | Martin | E21B 43/103 |
| 2017/0022781 | A1 * | 1/2017 | Martin | E21B 33/1208 |
| 2019/0292874 | A1 * | 9/2019 | Saeed | E21B 33/128 |
| 2020/0072019 | A1 * | 3/2020 | Tonti | E21B 33/1285 |

* cited by examiner

*Primary Examiner* — Nicole Coy
(74) *Attorney, Agent, or Firm* — MH2 Technology Law Group LLP

(57) ABSTRACT

A downhole tool includes an engaging member configured to increase in radial dimension from a run-in configuration to a set configuration, and to engage a surrounding tubular in the set configuration, and a plurality of buttons embedded in the engaging member. The plurality of buttons are positioned in radial alignment with or radially inward of an outer surface of the engaging member until at least a portion of the engaging member is increased in the radial dimension. The plurality of buttons are configured to extend radially outward of the outer surface of the engaging member and engage the surrounding tubular in when the radial dimension of the at least a portion of the engaging member is increased.

19 Claims, 3 Drawing Sheets

DOWNHOLE TOOL WITH RECESSED BUTTONS

CROSS-REFERENCE TO RELATED APPLICATIONS

This application claims priority to U.S. Provisional patent application having Ser. No. 62/751,241, which was filed on Oct. 26, 2018 and is incorporated herein by reference in its entirety.

BACKGROUND

A plug is a type of downhole tool that is designed to isolate two (e.g., axially-offset) portions of a wellbore. More particularly, once the plug is set in the wellbore, the plug isolates upper and lower portions of the wellbore while the upper portion is tested, cemented, stimulated, produced, injected into, or the like.

Plugs often include one or more slips that are configured to expand radially-outward and into contact with a surrounding tubular (e.g., a casing) or the wall of the wellbore when the plug is set, to anchor the plug in place. The outer radial surfaces of the slips may include a plurality of teeth or wickers that are configured to drive or "bite" into the surrounding tubular or the wall of the wellbore to improve the strength of the anchor.

Traditionally, the slips are made from a material, such as cast iron, that is hard enough to bite into the surrounding tubular (generally steel casing). In non-retrievable plugs, that is, plugs that are set and do not provide a mechanism by which the slips can be released, the plugs are typically drilled or milled to restore fluid communication through the casing. The hard material of the slips can make removing the plugs more difficult. Accordingly, other materials have been used more recently for slips, such as composite materials (e.g., carbon-fiber reinforced materials) and magnesium. These materials are easier to mill out, or can even be configured to dissolve after a period of time in the downhole environment. However, these materials typically are not hard enough to bite into the casing. As such, inserts or "buttons" are attached to the slips. The inserts are typically made from a ceramic or carbide material, and are formed with a thin outer edge that is oriented to bite into the casing.

A challenge with using such buttons is maintaining this edge while running the plug into the wellbore. During such run-in, the exposed edge can abrade against the casing and wear down prematurely. A variety of designs attempting to protect the buttons have been implemented with varying success; however, such designs typically add to the expense of the plug or impede the operation of the buttons.

SUMMARY

Embodiments of the disclosure may provide a downhole tool including an engaging member configured to increase in radial dimension from a run-in configuration to a set configuration, and to engage a surrounding tubular in the set configuration, and a plurality of buttons embedded in the engaging member. The plurality of buttons are positioned in radial alignment with or radially inward of an outer surface of the engaging member until at least a portion of the engaging member is increased in the radial dimension. The plurality of buttons are configured to extend radially outward of the outer surface of the engaging member and engage the surrounding tubular in when the radial dimension of the at least a portion of the engaging member is increased.

Embodiments of the disclosure may also provide a method for setting a downhole tool. The method includes deploying the downhole tool into a surrounding tubular of a wellbore, the downhole tool being in a run-in configuration. In the run-in configuration, buttons of the downhole tool are embedded within an engaging member of the downhole tool. The method also includes pressing the engaging member of the downhole tool radially outward, so as to move the downhole tool into a set configuration, wherein pressing the engaging member causes the buttons to extend radially outwards from the engaging member and extend into the surrounding tubular.

Embodiments of the disclosure may also provide a downhole tool including a sleeve having an outer diameter and an inner diameter, and a first cone including a tapered outer surface. The tapered outer surface defines a first diameter that is smaller than the inner diameter of the sleeve, and a second diameter that is greater than the inner diameter of the sleeve. The first cone is configured to be advanced into the sleeve starting with the first diameter and proceeding at least partially to the second diameter, so as to increase the outer diameter of the sleeve, such that the sleeve engages a surrounding tubular. The tool further includes a plurality of buttons at least partially embedded in the sleeve. The plurality of buttons each include a marking edge defining a radially-outermost extent of each of the plurality of buttons. When the first cone is advanced into the sleeve, the first cone applies a radially-outward force on a first one of the buttons, causing the marking edge of the first one of the buttons to extend radially outward from the sleeve. The first one of the buttons is configured to bite into the surrounding tubular when the first one of the buttons extends radially outward from the sleeve.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
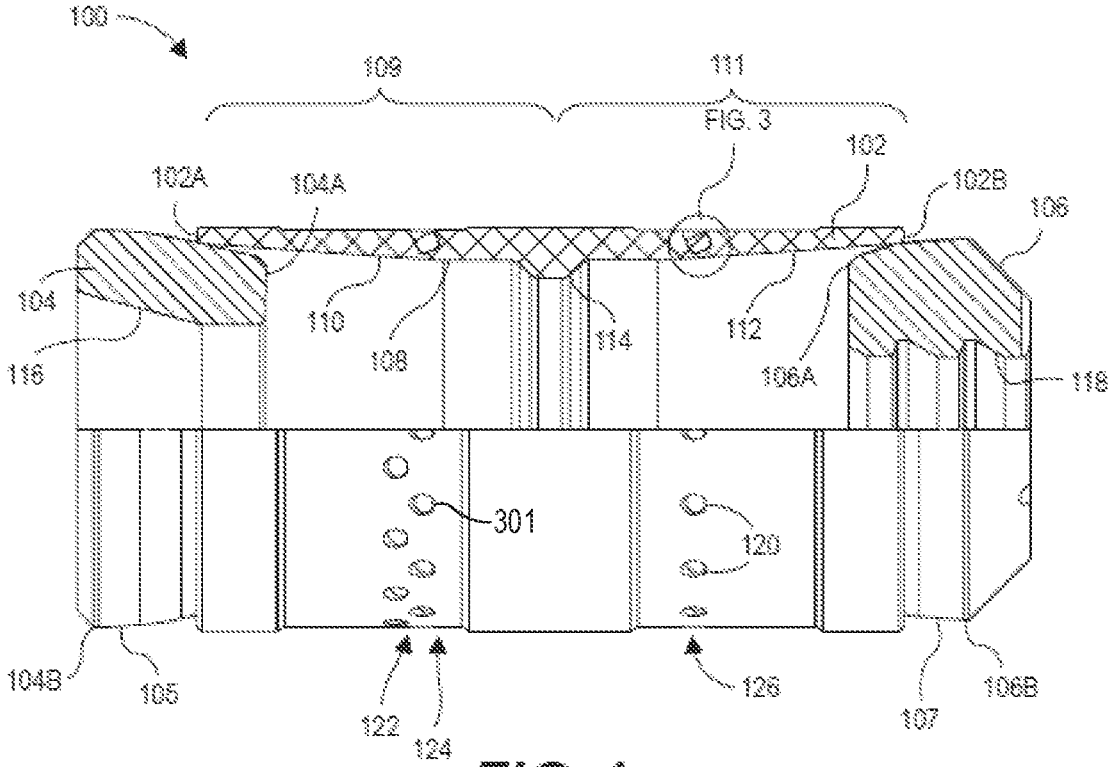
FIG. 1 illustrates a side, half-sectional view of a downhole tool in a run-in position, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, half-sectional view of a downhole tool 100, according to an embodiment. The illustrated downhole tool 100 is a plug (e.g., bridge plug, frac plug, etc.), which is configured to increase in outer radial dimension (e.g., "expand") and engage a surrounding tubular (e.g., casing, liner, wellbore wall, etc.) in order to set in the surrounding tubular. It will be appreciated that this downhole tool 100 is merely one example among many such tools that could be employed consistent with the present disclosure. An example of one such tool 100 is discussed and described in U.S. Patent Publication No. 2018/0266205, which is incorporated herein by reference in its entirety, to the extent not inconsistent with the present disclosure.

The downhole tool 100 includes an engaging member 102, such as a sleeve (for convenience, the engaging member 102 may be referred to herein as a sleeve 102, consistent with the illustrated embodiment), as well as an upper cone 104, and a lower cone 106. The sleeve 102 is configured to be deformed radially outwards by movement of the upper cone 104, 106, thereby providing the increase in radial dimension. As such, the sleeve 102 may be said to "expand," although the volume of the sleeve 102 itself may not change. Other engaging members may include slips assemblies, which may likewise increase in radial dimension, e.g., by pivoting outward.

In the illustrated embodiment, the sleeve 102 may include open ends 102A, 102B. The sleeve 102 may have two portions 109, 111, and may define an inner bore 108 extending between the two open ends 102A, 102B. Further, the inner bore 108 has two reverse-tapered sections 110, 112, each extending respectively along one of the two portions 109, 111. A shoulder 114 extends inward from the inner bore 108 between the two reverse-tapered sections 110, 112.

The sleeve 102, representing an embodiment of the engaging member, may be configured to increase in radial dimension, so as to engage a surrounding tubular. For example, the cones 104, 106 may be configured to be moved closer together so as to press the sleeve 102 outward, such that the sleeve 102 engages the surrounding tubular. In an embodiment, the cones 104, 106 fit into the open ends 102A, 102B, and may be tapered. The cones 104, 106 may each define an outer surface 105, 107 that has a first end 104A, 106A with a smaller diameter, a second end 104B, 106B with a larger diameter, and an increasing diameter therebetween as proceeding axially, i.e., parallel to a central axis of the tool 100 (horizontal, as shown in the Figures), along the outer surfaces 105, 107.

The reverse-tapered sections 110, 112 may be generally complementary to the outer surfaces 105, 107 of the cones 104, 106, respectively. The smallest diameter of the upper cone 104, e.g., at its first end 104A, may be slightly smaller than the inner diameter of the end 102A of the sleeve 102, and may be receivable therein, as shown. Likewise, the reverse-tapered section 112 may be configured to receive the first end 106A of the lower cone 106, as the end 102B of the sleeve 102 may be larger than the smaller end 106A of the cone 106. The cones 104, 106 may be driven together, such that the cones 104, 106 advance into the sleeve 102, at least partially to, or past, in this embodiment, the second, larger diameter ends 104B, 106B thereof. The cones 104, 106 may press the respective portions 109, 111 of the sleeve 102 radially outwards as the cones 104, 106 are advanced toward the shoulder 114 and one another.

In various embodiments, the upper cone 104 may provide an upwardly-facing valve seat 116 configured to catch and seal with an obstructing member, e.g., a ball. Further, the lower cone 106 may include teeth 118 configured to engage with a setting tool that forces the lower cone 106 upward, while forcing the upper cone 104 downward, thereby adducting the cones 104, 106 toward one another.

The sleeve 102 and/or either or both cones 104, 106 may be made from a relatively soft, ductile material, in comparison to the material, e.g., steel, that makes up the surrounding tubular into which the tool 100 is deployed (e.g., casing). In particular, in some embodiments, the sleeve 102 and/or either or both cones 104, 106 may be made from a dissolvable metal. In a specific embodiment, the sleeve 102 and/or either or both cones 104, 106 may be made from magnesium.

The downhole tool 100 also includes inserts or "buttons" 120, which are embedded into the sleeve 102. The buttons 120 may be made from a relatively hard material, in comparison to the sleeve 102, cones 104, 106, and/or the surrounding tubular. For example, the buttons 120 may be made from a carbide or ceramic material.

The buttons 120 may be disposed in one or more rows that extend circumferentially around the sleeve 102. In the illustrated embodiment, three such rows 122, 124, 126 are provided. The rows 122, 124, 126 are axially separated from one another, with the upper two rows 122, 124 being closer together and the lowest row 126 being spaced farther apart from the middle row 124. Further, the buttons 120 in the rows 122, 124 may be in the first portion 109 of the sleeve 102, while the buttons 120 in the row 126 may be in the second portion 111 of the sleeve 102. It will be appreciated that various configurations of rows, or any other pattern for implementing the buttons 120 may be employed, with the illustrated embodiment being just one among many contemplated.

Figure 2:
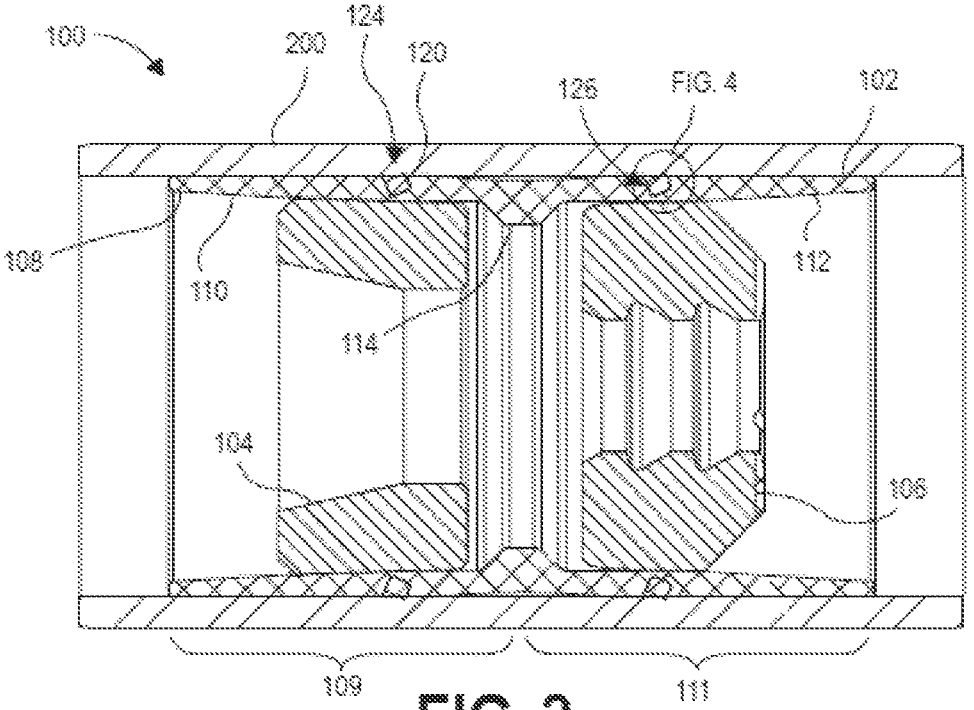
FIG. 2 illustrates a side, cross-sectional view of the downhole tool in a set position, according to an embodiment.

FIG. 2 illustrates a side, cross-sectional view of the downhole tool 100 in a set configuration, according to an embodiment. As shown, the cones 104, 106 have been adducted together, e.g., through the use of a setting tool and/or force applied via an obstructing member. Various other ways of setting various other types of tools that may be implemented consistent with the present disclosure may also be used. In the illustrated embodiment, the sleeve 102 is pressed radially outward, essentially linearly for a given axial cross-section, rather than pivoted as with a slips assembly.

The adducting of the cones 104, 106, which may or may not result in either or both cones 104, 106 engaging the shoulder 114, causes the sleeve 102 to be deformed radially outwards, until pressed against a surrounding tubular 200 (e.g., casing). In various embodiments, the buttons 120 are configured to bite into the surrounding tubular 200 through such outward pressing by the cones 104, 106, thereby securing the placement of the tool 100 in the surrounding tubular 200.

In at least one embodiment, the setting tool may be used to drive the upper cone 104 to and/or slightly past the first row 122 of buttons 120, causing the first row 122 of buttons 120 to engage the surrounding tubular 200, but may not cause the second row 124 of buttons 120 to be pressed outward into engagement with the surrounding tubular 200. Later, the upper cone 104 may catch an obstructing member (e.g., a ball), and pressure in the wellbore above the upper cone 104 may force the upper cone 104 farther toward the shoulder 114, which presses the second row 124 of buttons 120 (e.g., farther) outward and into engagement with the surrounding tubular 200.

In addition, the relatively uniform radial expansion of the sleeve 102 is configured to provide a seal between the sleeve 102 and the surrounding tubular 200. In other embodiments, rubber sealing elements can be positioned around the sleeve 102 (or any other engaging member) to form a seal with the surrounding tubular 200.

Figure 3:
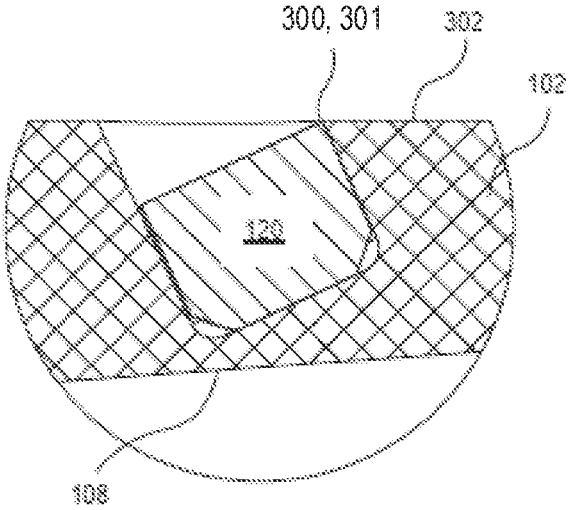
FIG. 3 illustrates a cross-sectional view of a button of the downhole tool in the run-in position, according to an embodiment.

FIG. 3 illustrates a side, cross-sectional view of one of the buttons 120 embedded in the sleeve 102 in the run-in position (as shown in FIG. 1), according to an embodiment. The button 120 is oriented at an angle with respect to straight radial (vertical, as shown in this view), such that an outer marking edge 300 is defined at the radial outer-most point of the button 120. It is specifically noted, referring again to FIG. 2, that the buttons 120 of the various different rows 122, 124, 126, on either portion 109 or 111, may be oriented at the same angle, and may thus face the same direction, despite being pressed outward by cones 104, 106 that move in opposite directions to set the sleeve 102. Thus, the buttons 120 in the rows 122, 124, 126 may cooperate to provide maximum resistance to movement of the tool 100 in one direction (e.g., downhole), while also providing resistance to movement of the tool 100 in the opposite direction (e.g., uphole). In contrast, slips assemblies, for example, generally have oppositely-oriented teeth on the top and bottom of the tool, which may be required by the pivoting expansion thereof. Since the sleeve 102 may be pressed radially outward, it may not contend with such pivoting-related issues for orienting the buttons 120. In other embodiments, however, the relative orientation of the buttons 120 may be selected according to any relevant design factors.

Referring specifically to FIG. 3 again, in the run-in configuration, the button 120 is embedded in the sleeve 102 to an extent that the marking edge 300, which represents the outermost extent of the button 120, is radially aligned with, or radially within, an outer surface 302 of the sleeve 102. As such, during run-in, the sleeve 102 itself prevents the marking edge 300 of the button 120 from abrading against the surrounding tubular 200 (or anything else) and affecting the marking ability of the outer marking edge 300 of the button 120.

In the embodiment shown, in the run-in configuration, the marking edge 300 of the button 120 may be flush (in radial alignment with) the outer surface 302 of the sleeve 102. In another embodiment, in the run-in configuration, the marking edge 300 may be recessed below the outer surface 302. In another embodiment, in the run-in configuration, the marking edge 300 may extend outward from the outer surface 302.

Through operation of the tool 100 moving from the run-in configuration (FIG. 1) to the set configuration (FIG. 2), the button 120 is exposed at the same time as the radial thickness of the sleeve 102 reduces. As such, the button 120 extends outwards from the sleeve 102, and bites into the surrounding tubular 200.

Figure 4:
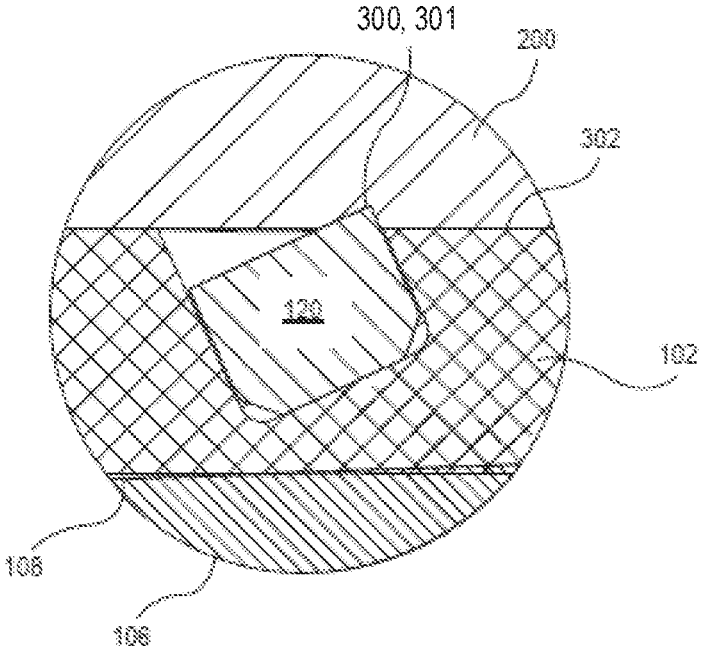
FIG. 4 illustrates a cross-sectional view of the button of the downhole tool in the set position, according to an embodiment.

FIG. 4 illustrates a side, cross-sectional view of the button 120 in the set configuration, according to an embodiment. As the cone 104 (the operation may be the same for buttons 120 that are pressed by the upper cone 104) pushes into the sleeve 102, the material thickness of the sleeve 102 (i.e., between the outer surface 302 and the inner bore 108) is reduced. Without being bound by theory, this is considered to occur because the diameters of the outer surface 302 and the inner bore 108 increase, and thus to maintain the same or even nearly the same cross-sectional area for the annulus therebetween, the diameters of the outer surface 302 and the inner bore 108 converge, thereby thinning the annulus. Further, the material of the sleeve 102 (e.g., magnesium) may be relatively ductile (in comparison to the buttons 120, for example), and may thus tend to deform, similar to extruding, axially along the surrounding tubular 200. The material of the sleeve 102 radially between the button 120 and the cone 106 may be in compression therebetween, and may thus force the button 120 radially outwards.

This combination of the sleeve 102 thinning, and the outward force applied by the cone 106 via the compression of the material between the cone 106 and the button 120, may force the button 120 radially outward from its initial position embedded within the sleeve 102. The edge 300 may define a small contact (or cutting surface) area 301, while the button 120 defines a large contact area with the sleeve 102. Thus, the pressure applied onto the sleeve 102 by the cone 106 is transmitted to the relatively large surface area of the button 120. In turn, the marking edge 300 of the button 120 transmits this force to the surrounding tubular 200 via the relatively small surface area 301. The pressure generated by the marking edge 300 yields the material of the surrounding tubular 200, thereby allowing the marking edge 300 of the button 120 to be driven into the surrounding tubular 200.

Accordingly, it will be appreciated that embodiments of the present disclosure may provide a downhole tool with an engaging member (e.g., a sleeve) with buttons that are initially fully embedded (recessed, retracted, etc.) in the engaging member, such that the engaging member protects the outer marking edge of the buttons from abrasion during run-in. As the tool is set, the outward pressing of the engaging member (e.g., sleeve) forces the buttons outward from within the engaging member, e.g., by thinning the material of the engaging member and pressing the buttons outward therefrom, thereby driving the buttons into the surrounding tubular. In this way, the buttons may anchor or secure the position of the downhole tool in the surrounding tubular when the downhole tool is set.

Figure 5:
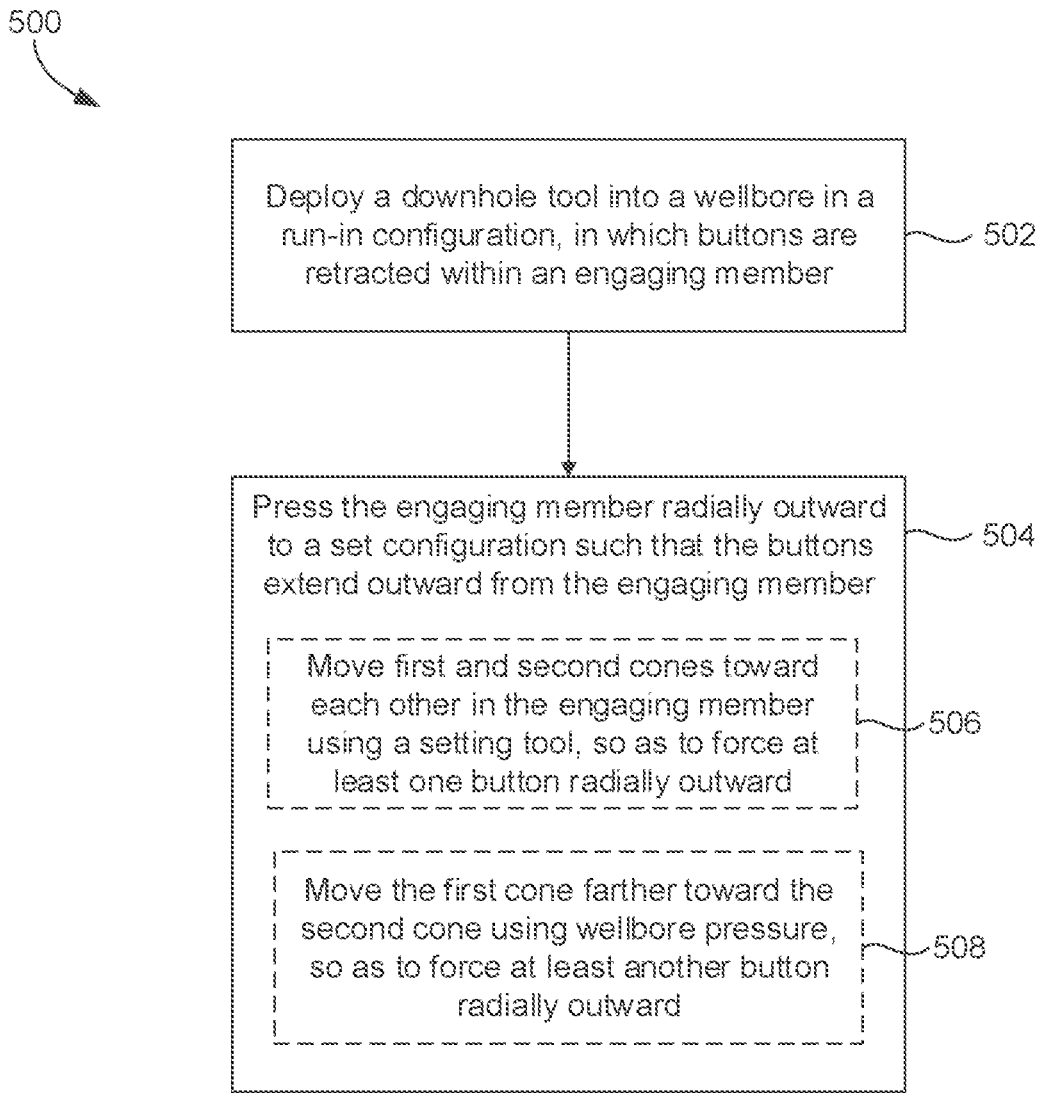
FIG. 5 illustrates a flowchart of a method for setting a downhole tool, according to an embodiment.

FIG. 5 illustrates a flowchart of a method 500 for setting a downhole tool, according to an embodiment. At least some embodiments of the method 500 may be executed by operation of the tool 100, discussed above with reference to FIGS. 1-4, and will thus be described with reference thereto. However, other embodiments of the method 500 may use other tools. The method 500 thus should not be considered limited to any particular structure, unless otherwise stated herein.

The method 500 may include deploying the downhole tool 100 into a surrounding tubular 200 of a wellbore, as at 502. During such initial deployment, the downhole tool 100 may be in a run-in configuration (FIG. 1), allowing the downhole tool 100 to be generally freely movable within the surrounding tubular (which may be casing, liner, etc.). In the run-in configuration, buttons 120 of the downhole tool 100 are embedded within an engaging member (e.g., sleeve 102) of the downhole tool 100. Specifically, the buttons 120 may be positioned in holes formed in the engaging member 102, such an outermost radial extent of the buttons 120 is aligned with or radially within an outer surface 302 of the engaging member 102, such that the engaging member 102 serves to protect the buttons 120 from abrasion in the wellbore during deployment. In a specific embodiment, an outer marking edge 300 of each of the buttons 120 is positioned radially inward of the outer surface 302 of the engaging member 102, when the engaging member 102 is in the run-in configuration.

At 504, the method 500 may include pressing the engaging member 102 radially outward. This may cause the downhole tool 100 to move or otherwise actuate into a set configuration. Such pressing causes the buttons 120 to extend radially outwards from the engaging member (e.g., sleeve 102) and drive into the surrounding tubular 200.

In an embodiment, pressing the engaging member 102 causes a material thickness of the engaging member 102 to decrease, which at least partially causes the buttons 120 to extend radially outward from the engaging member 102. In an embodiment, pressing the engaging member 102 includes moving a first (e.g., "upper") cone 104 within the engaging member 102. The first cone 104 applies a radially-outward force to the engaging member 102 and to a first button of the buttons 120, thereby driving the first button 120 radially outward into the surrounding tubular 200.

In an embodiment, pressing the engaging member 102 may also include moving a second (e.g., "lower") cone 106 within the engaging member 102 and toward the first cone 104. The second cone 106 presses at least a portion of the engaging member 102 radially outward, thereby driving a second button of the buttons 120 radially outward into the surrounding tubular 200. In a specific embodiment, the first and second buttons are both oriented at a same angle to a straight radial line, such that the first and second buttons face in a same direction.

In a specific embodiment, a setting tool may be used to draw the first and second cones 104, 106 toward one another, thereby successively pressing and deforming the engaging member 102 radially outwards, as at 506. For example, the setting tool may move the first cone 104 up to and/or slightly past a first row 122 of buttons 120, thereby driving the buttons 120 of the first row 122 outward into the surrounding tubular 200. The first cone 104 may, under force of the setting tool, not drive a second row 124 of buttons 120, which are lower on the engaging member 102 outwards. Rather, after the setting tool is removed, an obstructing member may be caught by the first cone 104, and a pressure above the obstructing member may force the first cone 104 downward, farther into the engaging member 102, as at 508. As a result, the first cone 104 may advance to and/or past the second row 124 of buttons 120 and drive the buttons 120 of the second row 124 radially outwards and into the surrounding tubular 200. Thus, the tool 100 may provide additional gripping force, by engaging the surrounding tubular 200 with additional buttons 120, when required due to high pressures.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

an engaging member having an outer surface, an inner surface positioned radially inward of the outer surface, a radial dimension defined by the outer surface, and a radial thickness defined by a distance between the inner and outer surfaces, the radial dimension and the radial thickness both extending along a radial direction that is perpendicular to a central longitudinal axis defined through the engaging member and around which the inner and outer surfaces are defined, wherein the engaging member is configured such that the radial dimension increases and the radial thickness decreases from a run-in configuration to a set configuration, and wherein the engaging member is configured to engage a surrounding tubular in the set configuration; and a plurality of buttons embedded in the engaging member, wherein the plurality of buttons are positioned in radial alignment with or radially inward of the outer surface of the engaging member until at least a portion of the engaging member is increased in the radial dimension and decreased in radial thickness, and wherein the plurality of buttons are configured to extend radially outward of the outer surface of the engaging member and engage the surrounding tubular in response to the radial dimension of the at least a portion of the engaging member increasing and the radial thickness thereof decreasing.

2. The downhole tool of claim 1, wherein the plurality of buttons each define a marking edge, wherein the marking edge is positioned radially inward of or in radial alignment with the outer surface of the engaging member before the at least a portion of the engaging member is increased in radial dimension, and wherein the marking edge embeds into the surrounding tubular when the at least a portion of the engaging member is increased in radial dimension.

3. The downhole tool of claim 1, wherein the engaging member is configured to reduce in radial thickness when the radial dimension thereof increases, which at least partially causes at least some of the plurality of buttons to extend radially outward of the engaging member.

4. The downhole tool of claim 1, wherein the engaging member comprises a sleeve.

5. The downhole tool of claim 4, further comprising a first cone and a second cone, wherein the sleeve comprises an inner bore, and wherein the first and second cones are configured to be adducted together so as to press the sleeve radially outwards.

6. The downhole tool of claim 5, wherein a first button of the plurality of buttons is driven radially outward by the first cone, and a second button of the plurality of buttons is driven outwards by the second cone, and wherein the first and second buttons are both oriented at a same angle to straight radial, such that the first and second buttons are both oriented in a same direction.

7. The downhole tool of claim 6, wherein the plurality of buttons each define a marking edge defining a cutting surface area, and wherein each of the buttons defines a surface area of contact with the engaging member, the surface area of contact with the engaging member being greater than the cutting surface area.

8. The downhole tool of claim 1, wherein the plurality of buttons are made from a first material, and wherein the engaging member is made at least partially from a second material, the first material being harder than the second material.

9. The downhole tool of claim 8, wherein the second material is configured to at least partially dissolve in a wellbore fluid.

10. The downhole tool of claim 1, wherein the outer surface of the engaging member has a constant diameter in the run-in configuration, and wherein the engaging member defines a plurality of holes that extend from the outer surface, the plurality of buttons each being positioned in one of the plurality of holes.

11. A method for setting a downhole tool, comprising:

deploying the downhole tool into a surrounding tubular of a wellbore, the downhole tool being in a run-in configuration, wherein, in the run-in configuration, buttons of the downhole tool are embedded within an engaging member of the downhole tool; and pressing the engaging member of the downhole tool radially outward, so as to move the downhole tool into a set configuration, wherein pressing the engaging member reduces a radial thickness between an inner surface and an outer surface of the engaging member, while increasing a radial dimension of the inner and outer surfaces, which causes the buttons to extend radially outwards from the engaging member and extend into the surrounding tubular, wherein the radial thickness and the radial dimension both extend in a direction perpendicular to a central longitudinal axis of the downhole tool around which the inner and outer surfaces are defined.

12. The method of claim 11, wherein an outer marking edge of each of the buttons is positioned radially inward of or radially aligned with an outer surface of the engaging member when the engaging member is in the run-in configuration.

13. The method of claim 11, wherein pressing the engaging member comprises moving a first cone within the engaging member, wherein the first cone applies a radially-outward force to the engaging member and to a first button of the buttons, thereby driving the first button radially outward into the surrounding tubular.

14. The method of claim 13, wherein pressing the engaging member comprises moving a second cone within the engaging member and toward the first cone, wherein the second cone applies a radially-outward force to the engaging member to a second button of the buttons, thereby driving the second button radially outward into the surrounding tubular.

15. The method of claim 14, wherein moving the first cone comprises:

moving the first cone within the engaging member using a setting tool, such that a first row of buttons, including the first button, is driven radially outward into engagement with the surrounding tubular, and a second row of buttons is not driven radially outward into engagement with the surrounding tubular; and moving the first cone farther within the engaging member using wellbore pressure and not the setting tool, such that the second row of buttons is driven radially outward into engagement with the surrounding tubular.

16. The method of claim 14, wherein the first and second buttons are both oriented at a same angle to a straight radial line, such that the first and second buttons face in a same direction.

17. A downhole tool, comprising:

a sleeve having an outer diameter and an inner diameter;

a first cone comprising a tapered outer surface, wherein the tapered outer surface defines a first diameter that is smaller than the inner diameter of the sleeve, and a second diameter that is greater than the inner diameter of the sleeve, and wherein the first cone is configured to be advanced into the sleeve starting with the first diameter and proceeding at least partially to the second diameter, so as to increase the outer diameter of the sleeve, such that the sleeve engages a surrounding tubular;

a plurality of buttons at least partially embedded in the sleeve, wherein the plurality of buttons each include a marking edge defining a radially-outermost extent of each of the plurality of buttons, wherein, when the first cone is advanced into the sleeve, the first cone applies a radially-outward force on a first one of the buttons, causing the marking edge of the first one of the buttons to extend radially outward from the sleeve, and wherein the first one of the buttons is configured to bite into the surrounding tubular when the first one of the buttons extends radially outward from the sleeve; and a second cone that is configured to be received into a second end of the sleeve and toward the first cone, so as to increase an outer diameter of a second portion of the sleeve, wherein a second button of the plurality of buttons is positioned in the second portion of the sleeve, such that advancing the second cone is configured to press the second button radially outward into engagement with the surrounding tubular, and wherein the first and second buttons, which are pressed radially outwards by movement of the first and second buttons toward one another, are angled with respect to straight radial such that the first and second buttons are oriented in a same direction.

18. The downhole tool of claim 17, wherein the sleeve is configured to reduce in radial thickness along at least a portion thereof when the first cone increases the outer diameter of the sleeve, at least partially causing the marking edge of the first one of the buttons to extend radially outward from the sleeve and to bite into the surrounding tubular.

19. The downhole tool of claim 17, wherein the marking edge of the buttons is radially inward of or radially aligned with an outer surface of the sleeve when the downhole tool is in a run-in configuration, and wherein the marking edge of the buttons is radially outward of the outer surface when the downhole tool is in a set configuration.

* * * * *